US012757991B2

(12) United States Patent
Kujawski et al.

(10) Patent No.: US 12,757,991 B2
(45) Date of Patent: Oct. 13, 2026

(54) ELECTRONIC DEVICE WRAP

(71) Applicant: Microsoft Technology Licensing, LLC, Redmond, WA (US)

(72) Inventors: Christopher Hays Kujawski, Bellevue, WA (US); Monique Chatterjee, Seattle, WA (US); Paul Ryan Sandoval, Kirkland, WA (US); Stacy N. Pollen, Seattle, WA (US); Corrie June Greening, Seattle, WA (US); Aaron David Thompson, Seattle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 338 days.

(21) Appl. No.: 18/235,810

(22) Filed: Aug. 19, 2023

(65) Prior Publication Data

US 2025/0058211 A1 Feb. 20, 2025

Related U.S. Application Data

(63) Continuation-in-part of application No. 29/900,243, filed on Aug. 18, 2023, now Pat. No. Des. 1,099,088.

(51) Int. Cl.
*A45C 11/00* (2006.01)
*A63F 11/00* (2006.01)

(52) U.S. Cl.
CPC ..... *A45C 11/003* (2025.01); *A45C 11/002* (2025.01); *A63F 11/00* (2013.01)

(58) Field of Classification Search
CPC ..... A63F 11/00
USPC ..... 150/154
See application file for complete search history.

(56) References Cited

U.S. PATENT DOCUMENTS

| | | | |
|---|---|---|---|
| 4,751,536 | A | 6/1988 | Ohmura |
| D423,465 | S | 4/2000 | Runnalls et al. |
| D515,588 | S | 2/2006 | Kirkwood |
| D531,409 | S | 11/2006 | Tüllmann et al. |
| D626,333 | S | 11/2010 | Orion |

(Continued)

FOREIGN PATENT DOCUMENTS

| | | |
|---|---|---|
| IN | 407598 | 4/2024 |
| JP | 1666726 S | 8/2020 |

(Continued)

OTHER PUBLICATIONS https://www.youtube.com/watch?v=g51mFRwxOC0 by Random (Year: 2023).*

(Continued)

*Primary Examiner* — Nathan J Jenness
*Assistant Examiner* — Jessica Kavini Tamil
(74) *Attorney, Agent, or Firm* — Rainier Patents, P.S.

(57) ABSTRACT

A device may include a first rigid panel having a contact surface and a cosmetic surface. A device may include a frictious material positioned on the contact surface of the first rigid panel. A device may include a second rigid panel having a contact surface and a cosmetic surface, the second rigid panel movably connected to the first rigid panel by a hinged connector. A device may include a selective connector, including: a first connection interface coupled to the first rigid panel, and a second connection interface coupled to the second rigid panel.

20 Claims, 8 Drawing Sheets

(56) References Cited

U.S. PATENT DOCUMENTS

| | | | | |
|---|---|---|---|---|
| 8,124,216 | B2 * | 2/2012 | Antonini | B32B 3/00 428/172 |
| D674,799 | S | 1/2013 | Kim | |
| D677,888 | S | 3/2013 | Sogabe | |
| D691,805 | S | 10/2013 | Chang | |
| D692,237 | S | 10/2013 | Chang | |
| D707,218 | S | 6/2014 | Yoonyoung | |
| D782,191 | S | 3/2017 | Adelman | |
| D800,732 | S | 10/2017 | Dang | |
| D812,053 | S | 3/2018 | Kacin et al. | |
| D831,002 | S | 10/2018 | Distefano | |
| D853,401 | S | 7/2019 | Moore | |
| D856,951 | S | 8/2019 | Odryna | |
| 11,051,595 | B1 * | 7/2021 | Yim | A45F 5/00 |
| D933,133 | S | 10/2021 | Ledbetter et al. | |
| D940,793 | S | 1/2022 | Kelter et al. | |
| D942,447 | S | 2/2022 | Ledbetter et al. | |
| D943,590 | S | 2/2022 | Price | |
| D954,709 | S | 6/2022 | Ledbetter et al. | |
| D962,056 | S | 8/2022 | Le | |
| D973,482 | S | 12/2022 | Kiefiuk | |
| D977,575 | S | 2/2023 | Chatterjee | |
| D988,327 | S | 6/2023 | Akana | |
| 11,679,315 | B2 * | 6/2023 | Wisnom | A63B 55/408 206/315.3 |
| D991,261 | S | 7/2023 | Chan | |
| D1,028,990 | S | 5/2024 | Lee | |
| D1,034,616 | S | 7/2024 | Kim | |
| D1,038,950 | S | 8/2024 | Lee | |
| D1,043,699 | S | 9/2024 | Lee | |
| D1,054,425 | S | 12/2024 | Kim | |
| D1,060,358 | S | 2/2025 | Yen | |
| D1,099,088 | S | 10/2025 | Kujawski | |
| 2003/0192759 | A1 | 10/2003 | Godshaw | |
| 2004/0195146 | A1 | 10/2004 | Lopez | |
| 2009/0009945 | A1 | 1/2009 | Johnson | |
| 2009/0129866 | A1 * | 5/2009 | Smallwood | E02D 17/202 405/16 |
| 2010/0078343 | A1 * | 4/2010 | Hoellwarth | B29C 45/14639 206/320 |
| 2011/0000805 | A1 | 1/2011 | Ho | |
| 2012/0024466 | A1 | 2/2012 | Bruette | |
| 2012/0325689 | A1 | 12/2012 | Wibby | |
| 2013/0277084 | A1 | 10/2013 | McCarthy | |
| 2016/0323002 | A1 * | 11/2016 | Cho | H04B 1/3888 |
| 2024/0126334 | A1 | 4/2024 | Lee | |
| 2024/0389727 | A1 | 11/2024 | Yang | |

FOREIGN PATENT DOCUMENTS

| | | |
|---|---|---|
| KR | 20140001365 U | 3/2014 |
| WO | 235595 | 2/2025 |

OTHER PUBLICATIONS

Notice to Grant Received for Chinese Application No. 202430082016.6, mailed on Feb. 12, 2025, 6 pages (English Translation Provided).
Office Action Received for Chinese Application No. 202430082016.6, mailed on Dec. 10, 2024, 2 pages. (English Translation Provided).
International Search Report and Written Opinion received for PCT Application No. PCT/US2024/039461, Nov. 6, 2024, 16 pages.
"Magnetic Smart Wraps for Xbox Series X Console, Full Protection Protective Cover Case for Xbox Series X Accessories with Premium PU Leather and Soft Inner Lining—White", Retrieved from the URL: https://a.co/d/7YqizA2, 2023, 06 Pages.
"Wraps for Xbox Series X Console, Mytrix Custom X-Box Series X Cover Skin, Magnetic Protective Case for Easy Installation, Full Protection—Gray Camo", Retrieved from the URL: https://a.co/d/a2UliyJ, 2023, 06 Pages.
Notice of Allowance mailed on Jun. 24, 2025, in U.S. Appl. No. 29/900,243, 10 Pages.
International Preliminary Report on Patentability (Chapter I) received for PCT Application No. PCT/US2024/039461, mailed on Mar. 5, 2026, 10 pages.
"Magnetic Wraps for Xbox Series X Console Accessories, for Starfield Design Cover Skin with Premium PU Leather, Magnetic Closure Wrap & TOP Cover for Xbox Series X, Full Protection", Woliber, Retrieved from URL: https://www.amazon.com/dp/B0D8L69Y23, Jul. 2, 2024, 6 pages.
"Prociv Wraps for Xbox Series X Console", Walmart.com, Retrieved from URL: https://www.walmart.com/ip/Wraps-for-Xbox-Series-X-Console-Custom-X-Box-Series-X-Cover-Skin-Magnetic-Protective-Case-for-Easy-Installation-Full-Protection-White/5286344795, Retrieved on: Nov. 20, 2025, 3 Pages.
Chatterjee, Monique, "New Xbox Console Wraps—Experience the Power of Series X in Style", Starfield-inspired console wrap pictured therein, Retrieved from URL: https://news.xbox.com/en-us/2023/08/21/xbox-series-x-console-wraps-starfield-camo/, Aug. 21, 2023, 6 pages.
Ex Parte Quayle Action mailed on Dec. 29, 2025, in U.S. Appl. No. 29/900,244, 06 pages.
Ex Parte Quayle Action mailed on Dec. 29, 2025, in U.S. Appl. No. 29/900,245, 06 pages.
Notice of Allowance mailed on Feb. 20, 2026, in U.S. Appl. No. 29/900,245, 7 pages.
Notice of Allowance mailed on Mar. 24, 2026, in U.S. Appl. No. 29/900,244, 07 pages.

* cited by examiner

ELECTRONIC DEVICE WRAP

BACKGROUND

Background and Relevant Art

Electronic devices are increasingly a personal expression of the user. Customization of the exterior appearance of an electronic device allows a more individual experience and personal expression through their device.

BRIEF SUMMARY

In some aspects, the techniques described herein relate to a device including: a first rigid panel having a contact surface and a cosmetic surface; a second rigid panel having a contact surface and a cosmetic surface, the second rigid panel movably connected to the first rigid panel by a hinged connector; a frictious material positioned on at least one contact surface; and a selective connector, including: a first connection interface coupled to the first rigid panel, and a second connection interface coupled to the second rigid panel.

In some aspects, the techniques described herein relate to a device including: a first rigid panel having a contact surface and a cosmetic surface; a second rigid panel having a contact surface and a cosmetic surface, the second rigid panel movably connected to the first rigid panel by a hinged connector longitudinally between the first rigid panel and the second rigid panel; a frictious material positioned on at least one contact surface; at least one spacer protruding from at least one of the first rigid panel and the second rigid panel in a lateral direction perpendicular to a longitudinal direction, and a selective connector including: a first connection interface coupled to the first rigid panel, and a second connection interface coupled to the second rigid panel.

In some aspects, the techniques described herein relate to a system including: an electronic device wherein a first side of the electronic device includes a non-planar feature normal to the first side; and a wrap including: a first rigid panel having a contact surface and a cosmetic surface, a second rigid panel having a contact surface and a cosmetic surface, the second rigid panel movably connected to the first rigid panel by a hinged connector, a frictious material on at least one contact surface of the wrap, at least one alignment feature protruding from a contact surface of at least one rigid panel, and a selective connector including: a first connection interface coupled to the first rigid panel, and a second connection interface coupled to the second rigid panel.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the disclosure may be realized and obtained by means of the instruments and combinations particularly pointed out in the appended claims. Features of the present disclosure will become more fully apparent from the following description and appended claims or may be learned by the practice of the disclosure as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 1-2 is a front view of the wrap of FIG. 1-1.

FIG. 1-3 is a rear view of the wrap of FIG. 1-1.

FIG. 2-1 is a perspective view of a wrap including a plurality of rigid panels applied to an electronic device, according to at least some embodiments of the present disclosure.

FIG. 2-2 is a perspective view of the wrap of FIG. 2-1 wrapped around the electronic device.

FIG. 2-3 is a rear perspective view of the wrap of FIG. 2-2.

FIG. 3 is a side cross-sectional view of a rigid panel including a cover layer, according to at least some embodiments of the present disclosure.

FIG. 6-1 is a front view of a wrap with a graphic applied to the cosmetic surface(s), according to at least some embodiments of the present disclosure.

FIG. 6-2 is a rear view of the wrap of FIG. 6-1 with frictious material selectively applied to the contact surface(s) based at least partially on the graphic, according to at least some embodiments of the present disclosure.

FIG. 6-3 is a perspective cross-sectional view of the wrap of FIG. 6-1 with frictious material selectively applied to the contact surface(s) based at least partially on the graphic, according to at least some embodiments of the present disclosure.

DETAILED DESCRIPTION

The present disclosure relates generally to systems and methods for wrapping an electronic device. In some embodiments, a wrap includes a cosmetic surface that changes an appearance of at least a portion of the electronic device. For example, the wrap has different colors, patterns, textures, materials, etc., that alters the appearance of the housing or other portions of the electronic device. In some embodiments, the wrap has a contact surface oriented opposite the cosmetic surface and configured to contact the electronic device. In some embodiments, the contact surface has a frictious material positioned thereon to increase the coefficient of friction of the contact surface relative to the wrap material. For example, a frictious material including silicone may be applied to a fabric wrap to increase friction between the wrap and the electronic device surface.

In some embodiments, a wrap, according to the present disclosure, includes a plurality of rigid panels movably connected by a hinge or hinged connector. Each of the rigid panels has a contact surface and a cosmetic surface. In some embodiments, the cosmetic surface is continuous between the first rigid panel and the second rigid panel. For example, a single graphic (color, design, pattern, image, etc.) is continuous from the first rigid panel, across the hinged connector, and to the second rigid panel.

In some embodiments, the cosmetic surface of the first rigid panel and the cosmetic surface of the second rigid panel are discrete from one another. For example, a first graphic of the cosmetic surface of the first rigid panel and a second graphic of the cosmetic surface of the second rigid panel may have a gap between the two where the hinged connector is present. In some embodiments, one or more of the cosmetic surfaces and/or one or more of the rigid panels is removable from a backing layer, allowing further customization of the wrap.

In some embodiments, the wrap includes a selective connector. The selective connector allows a first connection interface coupled to the first rigid panel and a second connection interface coupled to the second rigid panel to selectively connect the first rigid panel and the second rigid panel. In some embodiments, when the selective connector is in a connected state and the wrap substantially encloses at least a portion of the electronic device, the frictious material on the contact surface(s) of the wrap retains the wrap in place on the electronic device.

Figure 1:
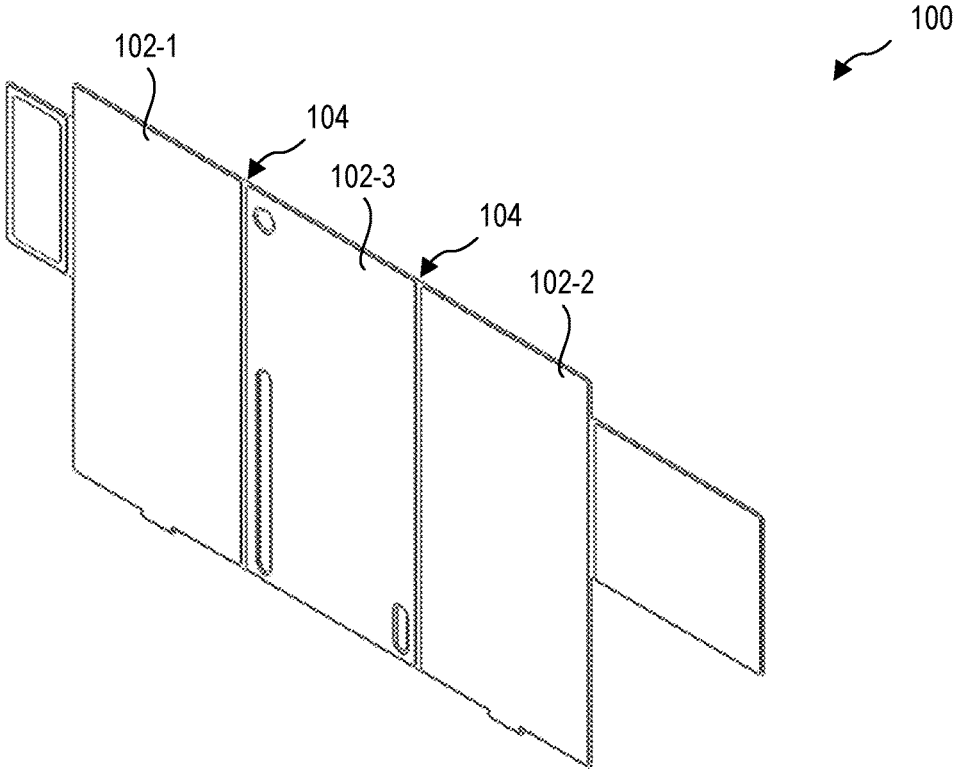
FIG. 1-1 is a perspective view of a wrap including a plurality of rigid panels, according to at least some embodiments of the present disclosure.
Figures 1, 2:
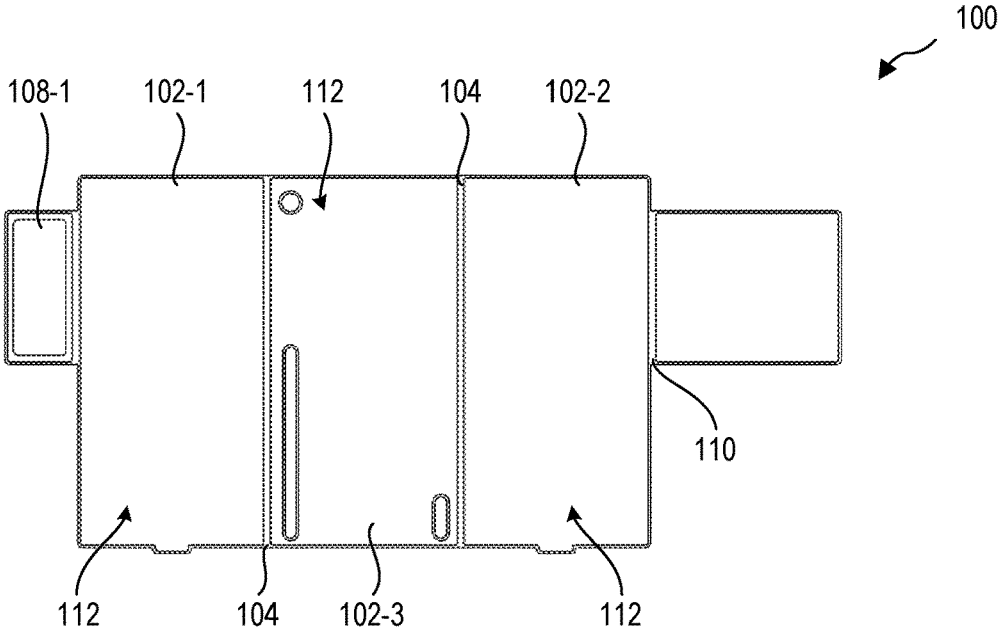
Figures 1, 2, 3:
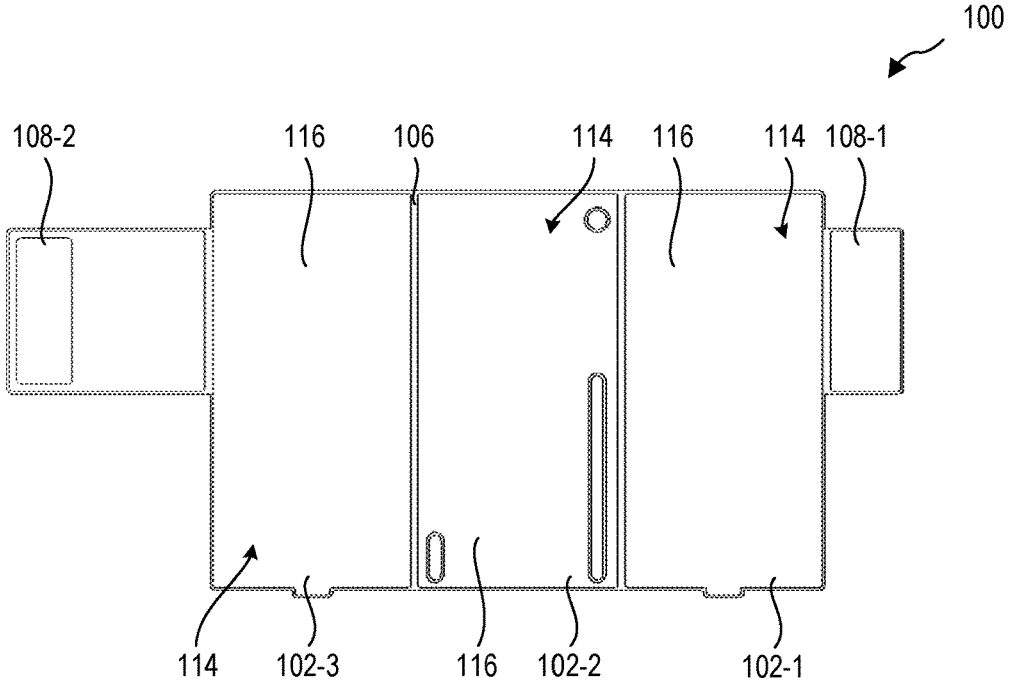
Figures 1, 2:
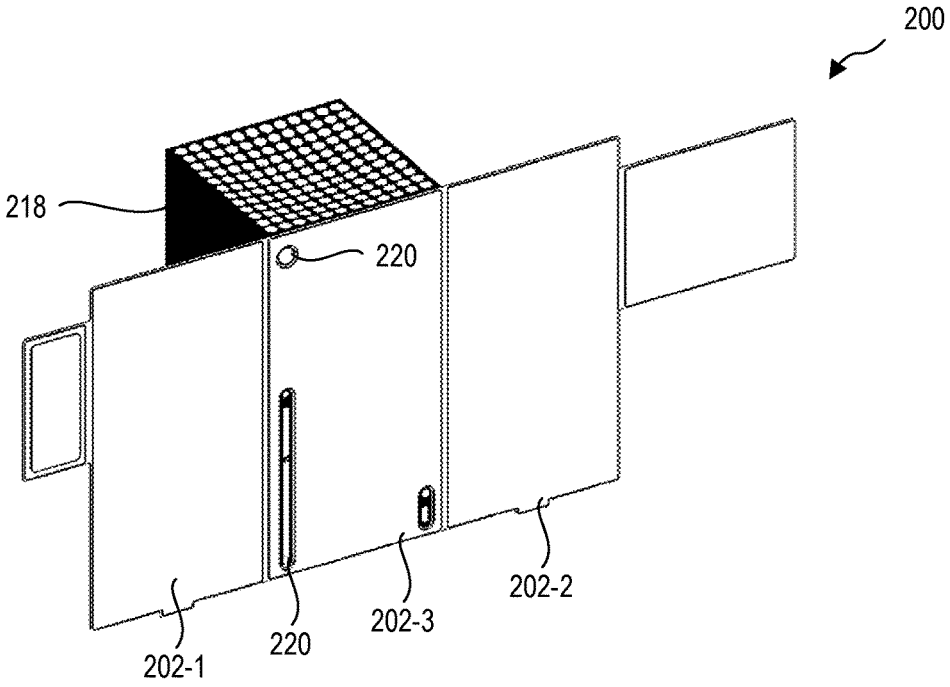
Figure 2:
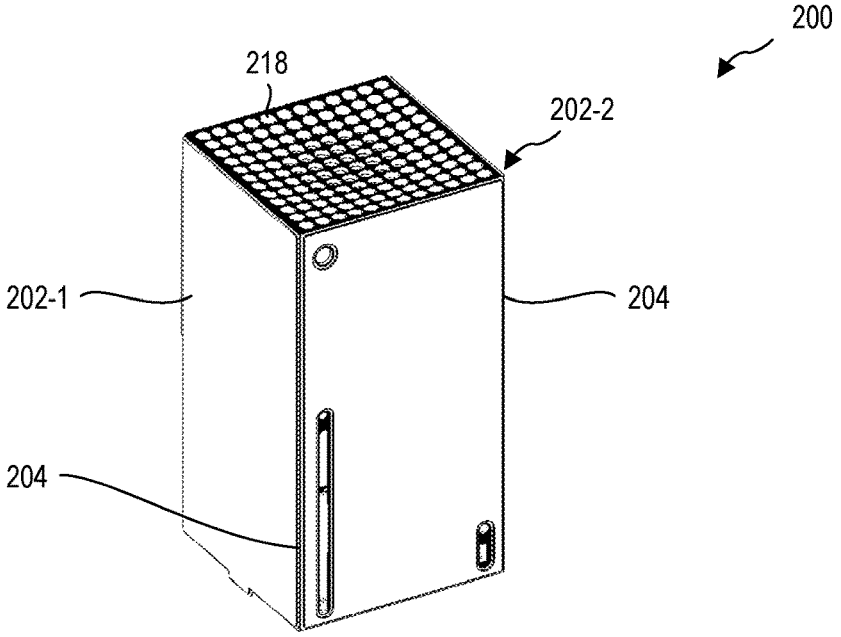
Figures 2, 3:
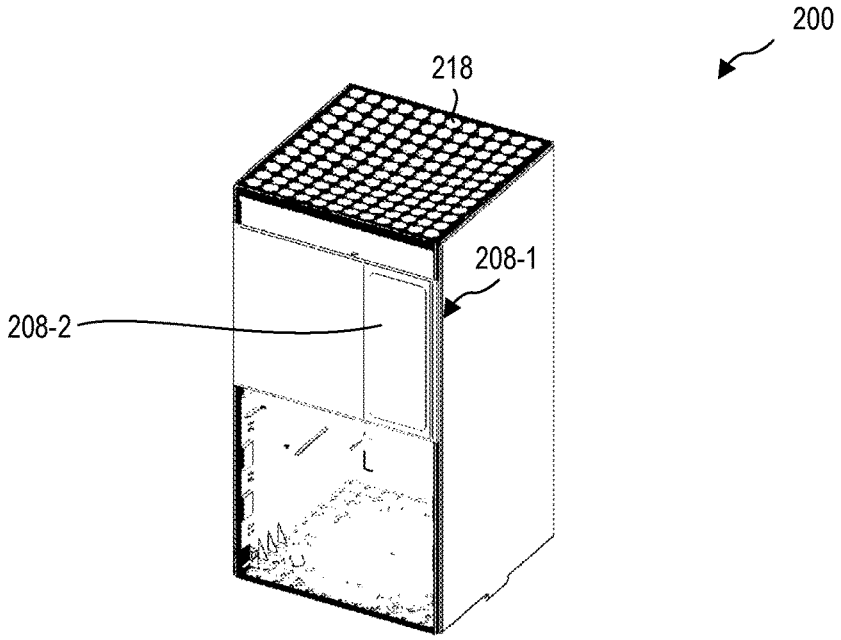
Figure 3:
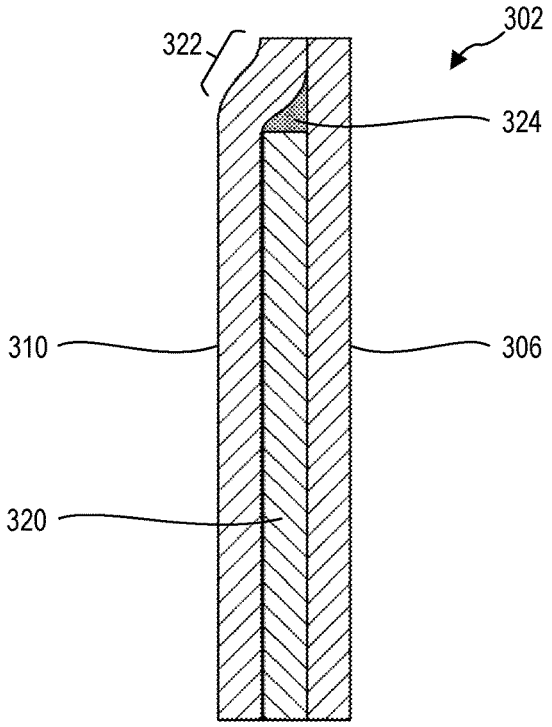

FIG. 1-1 through 1-3 illustrate an embodiment of a wrap 100. FIG. 1-1 is a perspective view of the wrap 100 including a plurality of rigid panels that are movably connected to one another. In some embodiments, a wrap 100 includes at least a first rigid panel 102-1 and a second rigid panel 102-2 movably connected to one another. In some embodiments, such as illustrated in FIG. 1-1 through 1-3, the wrap 100 includes at least a third rigid panel 102-3 positioned between the first rigid panel 102-1 and the second rigid panel 102-2.

In some embodiments, the rigid panel 102-1, 102-2, 102-3 includes a rigid board. In some embodiments, the rigid board is or includes glass fiber board (similar to that in a printed circuit board), a metal sheet, polyurethane or other rigid polymer, and other substantially rigid boards or sheets of material. In at least some embodiments, the rigid board is coupled to a backing layer. In at least some embodiments, the rigid board is coupled between a backing layer and a cover layer.

It should be understood that while components of the wrap 100 are described herein as rigid panels, in some embodiments, the rigid panel is a semi-rigid panel. In some embodiments, a rigid panel is any panel is more rigid than a backing layer of the panel. For example, a rigid panel 102-1, 102-2 may include a glass fiber board to reinforce the rigid panel relative to a sheet of fabric used for the backing layer of the rigid panel (as will be described in more detail herein). In some embodiments, a mylar or rubber sheet instead of glass fiber board provides a different aesthetic and/or reduces cost.

In at least one embodiment, a rigid panel includes a rigid board between a backing layer and a cover layer with a prayer seam enclosing the rigid board therein. In at least another embodiments, a rigid panel includes a rigid board between a backing layer and a cover layer with a butterfly seam enclosing the rigid board therein. In at least another embodiments, a rigid panel includes a rigid board between a backing layer and a cover layer with a J-seam enclosing the rigid board therein.

The first rigid panel 102-1 and the second rigid panel 102-2 (and, optionally, other rigid panels 102-3 therebetween) are connected by a hinged connector 104. For example, a hinged connector 104 includes any type of hinge, such as an elastically flexible living hinge. In some examples, the hinged connector 104 includes an axle, pin, or mechanical interlock around which the rigid panels rotate relative to one another.

Referring now to FIG. 1-2 and FIG. 1-3, in some embodiments, an elastically flexible hinged connector 104 includes a piece of backing material from the backing layer 106 that is continuous between at least two of the rigid panels. In at least one embodiment, the backing layer 106 is continuous from the first rigid panel 102-1 to the second rigid panel 102-2. In some embodiments, the elastically flexible hinged connector 104 includes a prayer seam for at least a portion of the hinged connector. In at least one embodiment, the backing layer is continuous from the first connection interface 108-1 (coupled to the first rigid panel 102-1) to the second connection interface 108-2 (coupled to the second rigid panel 102-2). In some embodiments, a backing layer 106 and a cover layer 110 are continuous from the first connection interface 108-1 (coupled to the first rigid panel 102-1) to the second connection interface 108-2 (coupled to the second rigid panel 102-2). In some embodiments, the backing layer 106 includes fabric, vinyl or other polymers, leather, suede, microfiber, and other flexible materials. In some embodiments, the cover layer 110 includes fabric, vinyl or other polymers, leather, suede, microfiber, and other flexible materials. In some embodiments, the backing layer 106 and the cover layer 110 are the same material. In some embodiments, the backing layer 106 and the cover layer 110 are different materials.

In some embodiments, the cover layer 110 is the cosmetic surface 112, as shown in the front view of FIG. 1-2. In some embodiments, the cosmetic surface 112 is applied to the surface of the cover layer 110, such as paint, decals, writing, or other graphics. In some embodiments, a surface of a rigid board of a rigid panel 102-1, 102-2, 102-3 is the cosmetic surface 112. In some embodiments, the cosmetic surface 112 is applied to the surface of a rigid board of a rigid panel 102-1, 102-2, 102-3, such as paint, decals, writing, or other graphics applied to the rigid board.

In some embodiments, the backing layer 106 is the contact surface 114 opposite the cosmetic surface, shown in FIG. 1-3. In some embodiments, the backing layer 106 has a frictious material 116 applied to the backing layer 106. In some embodiments, a frictious material 116 is applied to a surface of a rigid board of a rigid panel 102-1, 102-2, 102-3.

In some embodiments, the frictious material 116 is positioned on each of the rigid panels 102-1, 102-2, 102-3. In some embodiments, the frictious material 116 is positioned on at least one rigid panel 102-1, 102-2, 102-3. In some embodiments, the frictious material 116 is positioned on the backing layer 106 proximate at least one of the first connection interface 108-1 and the second connection interface 108-2.

In some embodiments, the frictious material 116 is a silicone. In some embodiments, the silicone is screen-printed on the backing layer 106. In some embodiments, the silicone is piped on the backing layer 106. In some embodiments, the frictious material 116 includes polyurethane, liquid rubber, or other polymers. In some embodiments, the frictious material 116 covers substantially all of the contact surface 114 of the rigid panel 102-1, 102-2, 102-3. In some embodiments, the frictious material 116 covers at least 50% of the contact surface 114 of the rigid panel 102-1, 102-2, 102-3. In some embodiments, the frictious material 116 covers at least 25% of the contact surface 114 of the rigid panel 102-1, 102-2, 102-3. In some embodiments, the frictious material 116 covers at least 10% of the contact surface 114 of the rigid panel 102-1, 102-2, 102-3.

In some embodiments, the frictious material 116 (such as silicone) is an outer layer applied to the backing layer 106 with one or more layers of material between the frictious material 116 and the backing layer 106. In some embodiments, the frictious material 116 is an outermost layer of a plurality of layers of frictious material. In some embodiments, the frictious material 116 is screen-printed onto the backing layer 106 in a plurality of layers to achieve a desired height of the frictious material 116. In some embodiments, filler layers between the backing layer 106 and the frictious material 116 include at least a second filler material that is different from the frictious material 116. The filler material may be cheaper than the frictious material 116, easier to apply to the backing layer 106 than the frictious material 116, provide additional structural rigidity to the frictious material 116. In at least one embodiments, the filler layer(s) increases a connection or adhesion strength between the frictious material 116 and the backing layer 106 relative to the frictious material 116 applied directly to the backing layer 106 without the filler layer(s).

In some embodiments, the frictious material 116 increases the coefficient of friction of the contact surface 114 relative to the backing layer 106 and/or the rigid boards of the rigid panels 102-1, 102-2, 102-3. In some embodiments, the frictious material 116 increases the coefficient of friction of the contact surface 114 relative to the backing layer 106 and/or the rigid boards of the rigid panels 102-1, 102-2, 102-3 without increasing an adhesion of the contact surface 114 to the electronic device surface. For example, the frictious material 116 increases the friction between the wrap 100 and a surface of the electronic device in a direction parallel to the surface of the electronic device without increasing an adhesion force in a direction normal to the surface of the electronic device. In some embodiments, the frictious material 116 is non-marking and/or non-marring of the surface of the electronic device.

In some embodiments, the selective connector includes a hook-and-loop connector, magnetic connector, snap connector, a clasp, a zipper (clasp locker), or other connection mechanism. In at least one example, a hook-and-loop selective connector (e.g., first connection interface 108-1 and second connection interface 108-2) includes a hook panel and a loop panel, where at least one of the hook panel and the loop panel is or includes a rigid panel. For example, the embodiment of the second connection interface 108-2 of FIG. 1-3 may be a loop panel that is a rigid panel. In some embodiments, a selective connector includes an elastic portion that provides a tension force on the wrap 100 when the selective connector is connected and the wrap 100 is positioned around at least a portion of the electronic device.

FIG. 2-1 through 2-3 illustrate wrapping an electronic gaming console 218 in an embodiment of a wrap 200, according to the present disclosure. The wrap 200 is positioned with the third rigid panel 202-3 (located between the first rigid panel 202-1 and the second rigid panel 202-2) on a front face of the electronic gaming console 218. In some embodiments, the wrap 200 includes one or more alignment features 220 that interlock with one or more non-planar features of the electronic gaming console 218 or other electronic device. For example, the prayer seam or other seam of an opening or aperture in the rigid panel protrudes in a direction normal to the contact surface, interlocking with and/or aligning the wrap 200 relative to a non-planar feature of the electronic gaming console 218 or other electronic device, such as an optical drive, a communications port, a power button, or other recesses or protrusions in the plane of the housing of the electronic gaming console 218 or other electronic device.

Referring now to FIG. 2-2, in some embodiments, the first rigid panel 202-1 and second rigid panel 202-2 each move around the hinged connector 204 relative to the third rigid panel 202-3 therebetween. FIG. 2-3 is a rear view of the wrap 200 and electronic gaming console 218 of FIG. 2-2 with the selective connector including the first connection interface 208-1 and second connection interface 208-2 connected.

FIG. 3 is a side cross-sectional view of a rigid panel 302 including a rigid board 320 therein. In some embodiments, the rigid board 320 is or includes glass fiber board (similar to that in a printed circuit board), a metal sheet, polyurethane or other rigid polymer, and other substantially rigid boards or sheets of material. In at least some embodiments, the rigid board 320 is coupled to a backing layer 306. In at least some embodiments, the rigid board 320 is coupled between a backing layer 306 and a cover layer 310. In at least one embodiment, a rigid panel 302 includes a rigid board 320 between a backing layer 306 and a cover layer 310 with a prayer seam 322 enclosing the rigid board 320 therein. In some embodiments, the rigid panel 302 includes a rigid board 320 adhered to a backing layer 306 and a cover layer 310 with an adhesive 324 and a prayer seam 322 enclosing the rigid board 320 therein. In at least another embodiments, a rigid panel 302 includes a rigid board 320 between a backing layer 306 and a cover layer 310 with a butterfly seam enclosing the rigid board 320 therein. In at least another embodiments, a rigid panel 302 includes a rigid board 320 between a backing layer 306 and a cover layer 310 with a J-seam enclosing the rigid board 320 therein.

Figure 4:
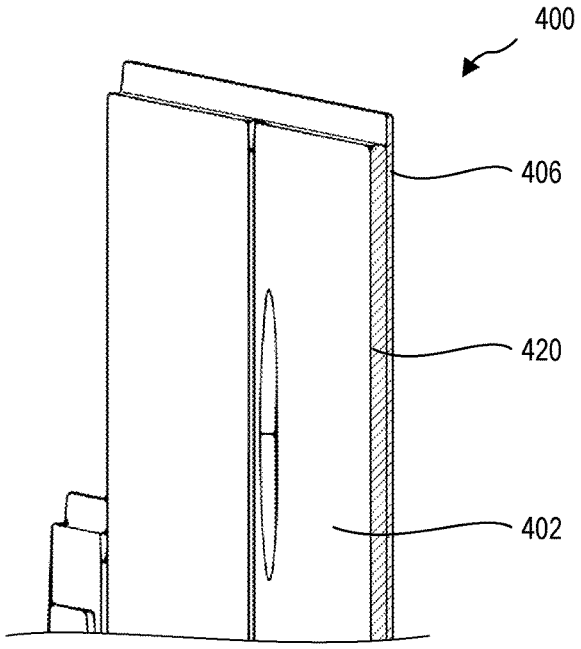
FIG. 4 is a perspective cross-sectional view of a rigid board coupled to a backing layer, according to at least some embodiments of the present disclosure.

FIG. 4 is a side cross-sectional view of an embodiment of a rigid panel 402 with a rigid board 420 adhered and/or bonded to a backing layer 406 without a cover layer. In some embodiments, the rigid board 420 is or has applied thereto a cosmetic surface, such as paint, decals, or other graphics. In some embodiments, the bare rigid board 420 is the cosmetic surface. In some embodiments, the rigid panel 402 includes one or more detachable rigid boards 420 that are detachable from the backing layer 406. For example, the rigid board 420 may be connected to the backing layer 406 by a reusable adhesive, by a hook-and-loop connector, magnetic connector, snap connector, a clasp, mechanical fasteners, or another connection mechanism.

Figure 5:
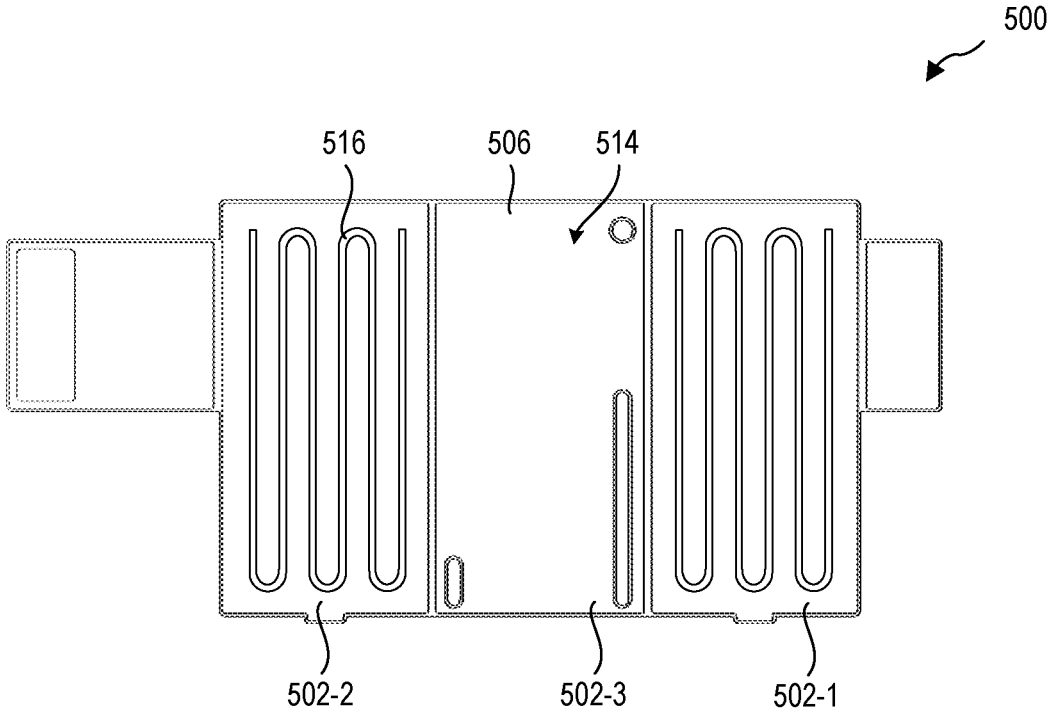
FIG. 5 is a rear view of a wrap with frictious material selectively applied to the contact surface(s), according to at least some embodiments of the present disclosure.

In some embodiments, a wrap, according to the present disclosure, provides additional benefits to the user and/or the electronic device. Referring now to FIG. 5, in some embodiments, the frictious material 516 and/or contact surface 514 of the wrap 500 provides an air gap on at least a portion of the contact surface 514. In some embodiments, the frictious material 516 is located on a portion of the contact surface 514 of one or more rigid panels 502-1, 502-2, 502-3. For example, in FIG. 5, the frictious material 516 provides air gaps between and adjacent to the strip(s) of frictious material 516 on the first rigid panel 502-1 and the second rigid panel 502-2. In some embodiments, the air gap allows air flow and/or thermal insulation between the surface of the electronic device and the rigid panel(s). In at least one embodiment, one or more rigid panels (such as the third rigid panel 502-3 of FIG. 5) lacks a frictious material 516 applied to the backing layer 506.

Figures 1, 6:
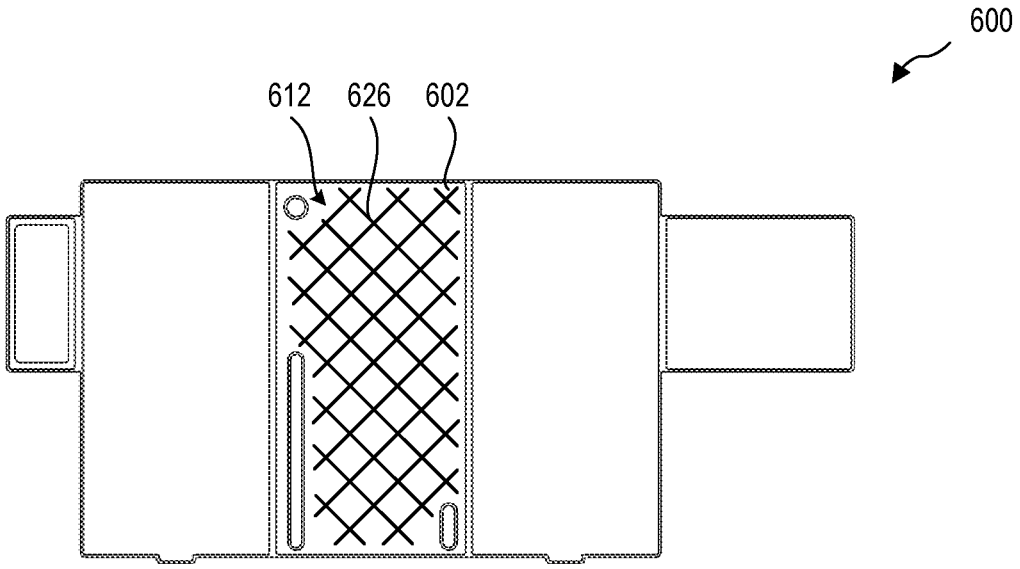
Figures 2, 6:
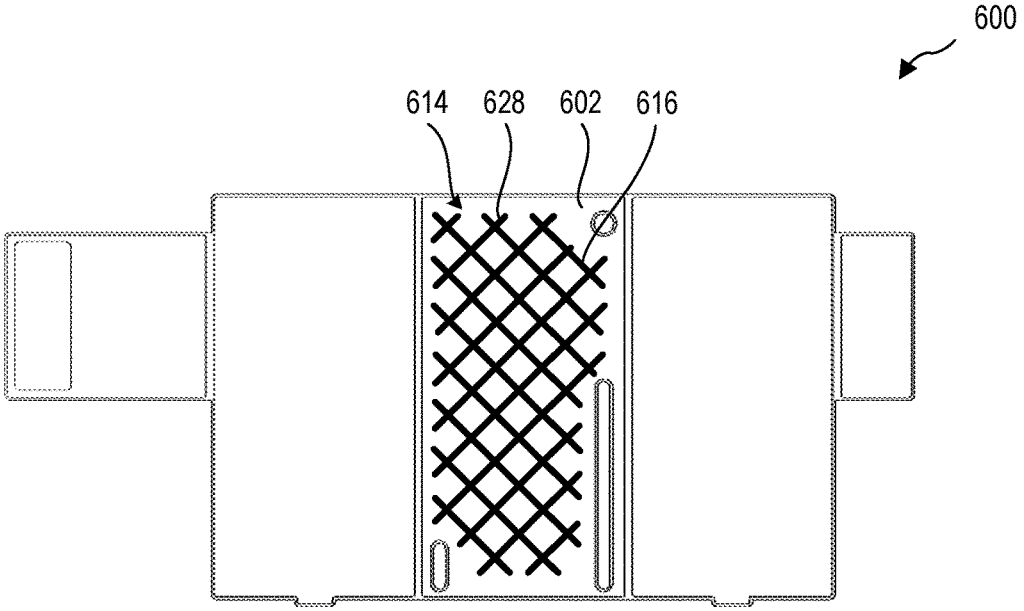
Figures 3, 6:
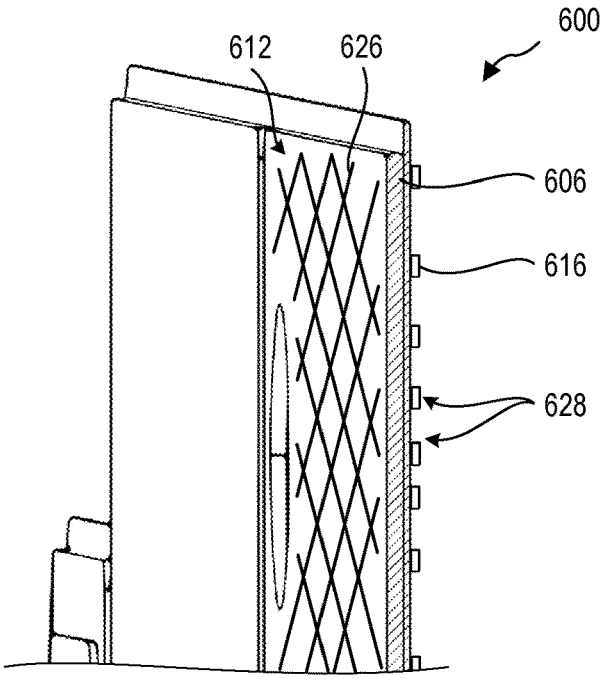

In some embodiments, the frictious material applied to the contact surface follows, mimics, or matches at least a portion of a graphic on the cosmetic surface of the wrap. FIG. 6-1 through 6-3 illustrate frictious material 616 aligned with a graphic on the cosmetic surface 612 of a rigid panel 602. FIG. 6-1 is a front view of an embodiment of a wrap 600 including a cosmetic line pattern 626 on a cosmetic surface 612 of the wrap 600. FIG. 6-2 is a rear view of the embodiment of a wrap 600 of FIG. 6-1 illustrating the frictious material 616 applied in a matching (inverted) line pattern 628 to the contact surface 614 of the rigid panel 602. FIG. 6-3 is a side cross-sectional view of the embodiment of a wrap 600 of FIG. 6-1 and FIG. 6-2 showing the alignment of the frictious material 616 applied to the backing layer 606 in a matching line pattern 628 corresponding to the cosmetic line pattern 626 on the cosmetic surface 612.

In some embodiments, alignment of the frictious material 616 with at least a portion of the graphic of the cosmetic surface 612 can provide a tactile relief to at least a portion of the cosmetic surface 612. In some embodiments, alignment of the frictious material 616 can create air gaps and associated temperature variations that correspond to the graphic during use of the electronic device. In some embodiments with a transparent or translucent rigid panel, alignment of the frictious material 616 with at least a portion of the graphic of the cosmetic surface 612 can allow light to pass through regions of the rigid panel where the frictious material is absent providing additional cosmetic options.

Figure 7:
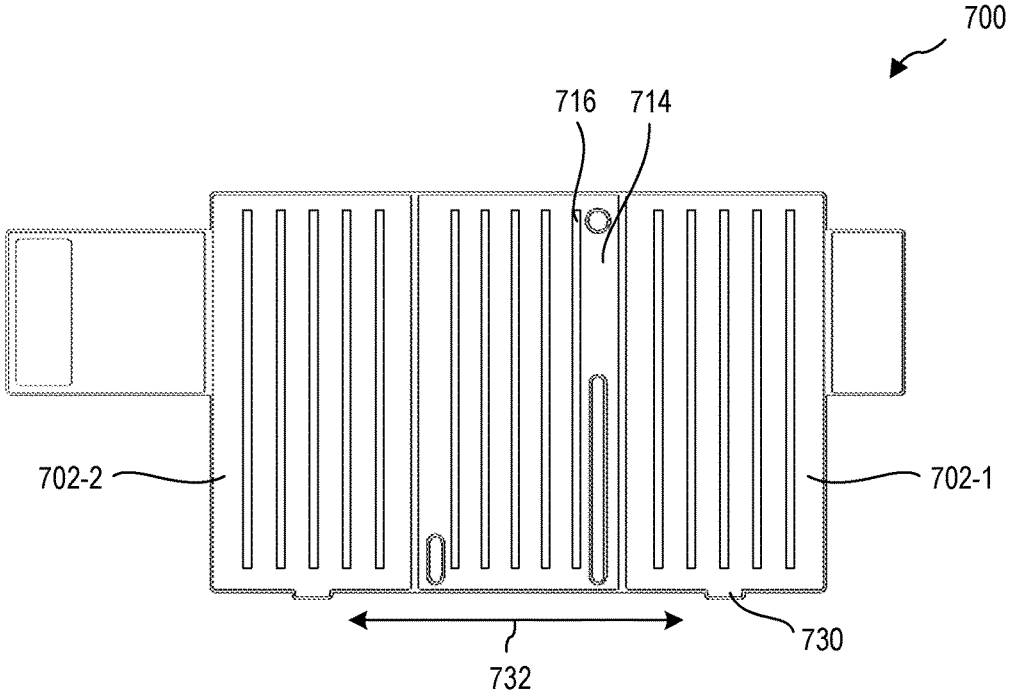
FIG. 7 is a rear view of a wrap with a frictious material applied to the contact surface(s) with air channels therebetween, according to at least some embodiments of the present disclosure.

FIG. 7 illustrates an embodiment of a wrap 700 with segments of frictious material 716 having air channels therebetween. As described herein, the use of segments of frictious material 716 on the contact surface 714 can allow air flow between the wrap 700 and the electronic device, limiting the surface temperature of the wrap 700 and allowing a user to more comfortably handle the device with wrap applied. In some embodiments, the rigid panel 702 includes a thermally conductive rigid board therein, allowing the rigid panel 702 to spread any received heat and further dissipate heat generated by the electronic device during use. In some embodiments, the rigid board is a thermally conductive metal board, such as aluminum or copper (or alloys thereof).

In some embodiments, the wrap 700 includes one or more spacers 730 located at a lateral edge 734 of a rigid panel 702 that protrude in a lateral direction perpendicular to a longitudinal direction 732 of the wrap 700. In some embodiments, the spacer 730 limits and/or prevents the wrap 700 inhibiting airflow to the electronic device. In some embodiments, the electronic device includes at least one intake or exhaust port proximate the lateral edge 734 of the wrap 700, and the spacer(s) 730 limit and/or prevent blockage of the intake or exhaust port by the wrap 700.

In some embodiments, the spacers 730 include a portion of the rigid board of the rigid panel 702. In some embodiments, the spacer 730 includes a reinforced portion of a seam, such as a prayer seam, a J-seam, or a butterfly seam, of the rigid panel 702. For example, the spacer 730 may be reinforced with additional adhesive between a cover layer and a backing layer to stiffen the seam at the spacer 730 to be more rigid than other portions of the seam. In some embodiments, the spacer 730 is integral with the seam of the rigid panel 702. In some embodiments, the spacer 730 is a discrete component affixed to the rigid panel 702. In some embodiments, the spacer 730 is positioned proximate to the longitudinal center of the lateral edge 734.

Figure 8:
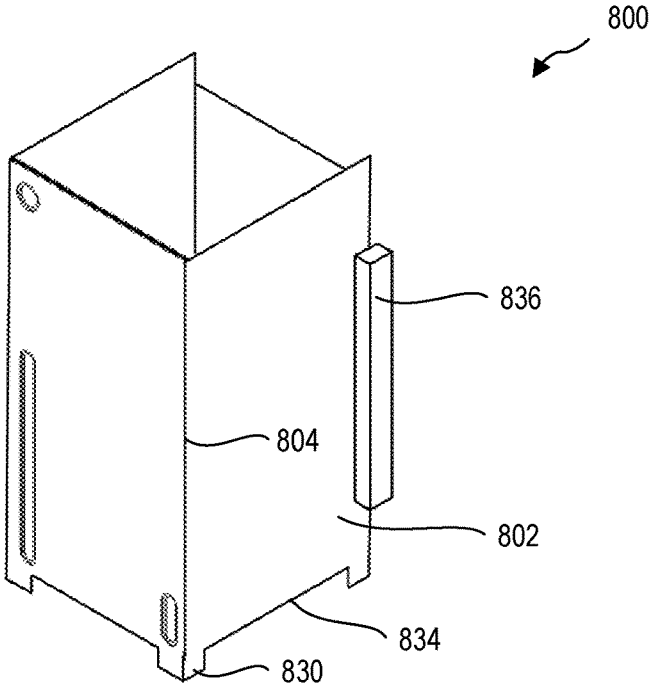
FIG. 8 is a perspective view of a wrap providing impact protection to an electronic device, according to at least some embodiments of the present disclosure.

FIG. 8 is a perspective view of an embodiment of a wrap 800 with spacers 830 proximate a hinged connector 804 of the wrap 800 on a lateral edge 834. In some embodiments, the spacer 830 proximate a hinged connector 804 allows the spacer 830 to contact the ground, a tabletop, or another surface first to provide impact protection to the electronic device within the wrap 800. As the wrap 800 includes rigid panels 802, the rigid panels 802 receive the impact at the corner with the spacer 830 and distribute the energy through the rigid panel(s) 802 over a larger area. In some embodiments, the wrap 800 includes bumpers or other reinforcements 836 of the wrap 800 to further absorb, distribute, or dissipate impact energy.

Figure 9:
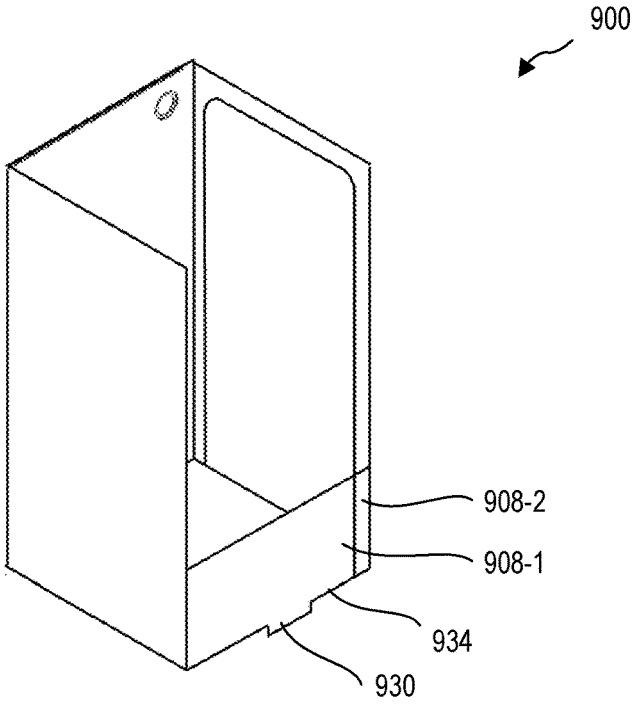
FIG. 9 is a rear perspective view of a wrap with a spacer proximate a selective connector, according to at least some embodiments of the present disclosure.

Referring now to FIG. 9, in some embodiments, a wrap 900 includes a spacer 930 on a rear side of the wrap 900 (when assembled on an electronic device) and/or proximate the selective connector including a first connection interface 908-1 and second connection interface 908-2. In some embodiments, the spacer 930 proximate the rear side and/or proximate the selective connector limits and/or prevents movement of the wrap 900 relative to the electronic device (e.g., slipping downward) without being visible to the user during use. The spacer 930 proximate the rear side and/or proximate the selective connector provides an additional cosmetic option while achieving the function of the spacer 930.

Figure 10:
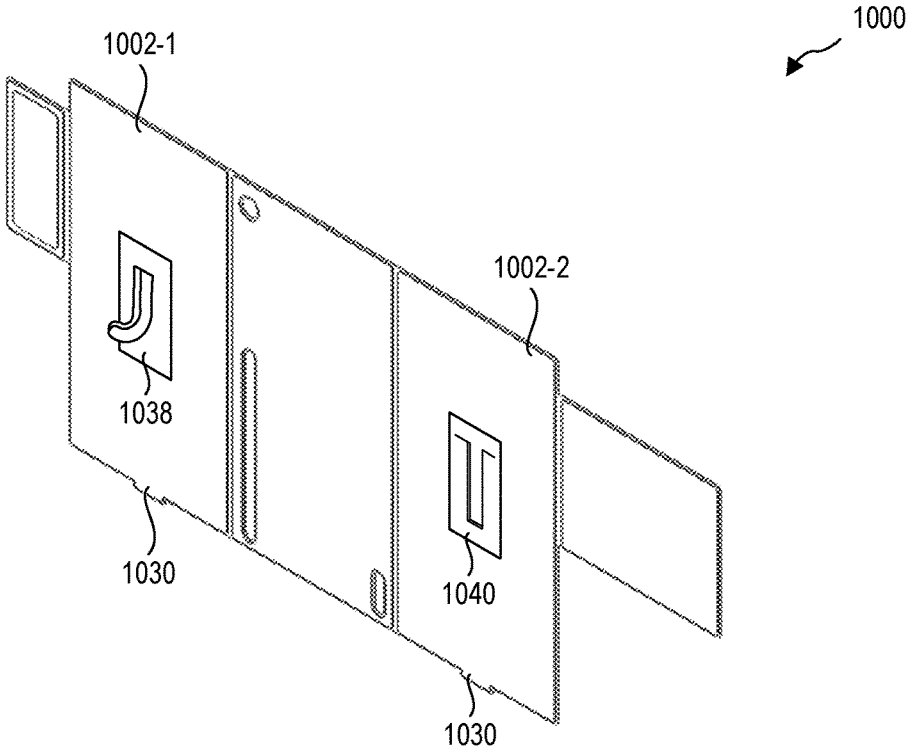
FIG. 10 is a perspective view of a wrap with accessory connections, according to at least some embodiments of the present disclosure.

FIG. 10 is a perspective view of an embodiment of a wrap 1000 including accessory supports 1038 and/or accessory connection points 1040. In some embodiments, the rigid panel(s) 1002-1, 1002-2 allow the wrap to support the mass of additional devices, such as accessory device(s) and peripheral devices for the wrapped electronic device. In some embodiments, the wrap 1000 includes an accessory support 1038, such as a headphones hook, such as on the first rigid panel 1002-1 illustrated in the embodiment of FIG. 10.

In some embodiments, the rigid panel includes an accessory connection point 1040, such as the slot illustrated on the second rigid panel 1002-2 in FIG. 10, that allows customization of the wrap 1000 and/or an accessory support 1038. In some embodiments, at least one of the accessory supports 1038 and/or accessory connection points 1040 is longitudinally or laterally aligned with a spacer 1030. For example, when an accessory device is supported by the accessory support 1038 and/or accessory connection point 1040, the rigid panel 1002-1, 1002-2 transfers the force of the weight of the accessory device to the ground, tabletop, or other surface on which the wrapped electronic device rests through the spacer 1030 contacting the ground, tabletop, or other surface.

INDUSTRIAL APPLICABILITY

The present disclosure relates generally to systems and methods for wrapping an electronic device. In some embodiments, a wrap includes a cosmetic surface that changes an appearance of at least a portion of the electronic device. For example, the wrap has different colors, patterns, textures, materials, etc., that alters the appearance of the housing or other portions of the electronic device. In some embodiments, the wrap has a contact surface oriented opposite the cosmetic surface and configured to contact the electronic device. In some embodiments, the contact surface has a frictious material positioned thereon to increase the coefficient of friction of the contact surface relative to the wrap material. For example, a frictious material including silicone may be applied to a fabric wrap to increase friction between the wrap and the electronic device surface.

In some embodiments, a wrap, according to the present, disclosure includes a plurality of rigid panels movably connected by a hinge or hinged connector. Each of the rigid panels has a contact surface and a cosmetic surface. In some embodiments, the cosmetic surface is continuous between the first rigid panel and the second rigid panel. For example, a single graphic (color, design, pattern, image, etc.) is continuous from the first rigid panel, across the hinged connector, and to the second rigid panel.

In some embodiments, the cosmetic surface of the first rigid panel and the cosmetic surface of the second rigid panel are discrete from one another. For example, a first graphic of the cosmetic surface of the first rigid panel and a second graphic of the cosmetic surface of the second rigid panel may have a gap between the two where the hinged connector is present. In some embodiments, one or more of the cosmetic surfaces and/or one or more of the rigid panels is removable from a backing layer, allowing further customization of the wrap.

In some embodiments, the wrap includes a selective connector. The selective connector allows a first connection interface coupled to the first rigid panel and a second connection interface coupled to the second rigid panel to selectively connect the first rigid panel and the second rigid panel. In some embodiments, when the selective connector is in a connected state and the wrap substantially encloses at least a portion of the electronic device, the frictious material on the contact surface(s) of the wrap retains the wrap in place on the electronic device.

In some embodiments, a wrap includes at least a first rigid panel and a second rigid panel movably connected to one another. In some embodiments, the wrap includes at least a third rigid panel positioned between the first rigid panel and the second rigid panel.

In some embodiments, the rigid panel includes a rigid board. In some embodiments, the rigid board is or includes glass fiber board (similar to that in a printed circuit board), a metal sheet, polyurethane or other rigid polymer, and other substantially rigid boards or sheets of material. In at least some embodiments, the rigid board is coupled to a backing layer. In at least some embodiments, the rigid board is coupled between a backing layer and a cover layer.

It should be understood that while components of the wrap 100 are described herein as rigid panels, in some embodiments, the rigid panel is a semi-rigid panel. In some embodiments, a rigid panel is any panel is more rigid than a backing layer of the panel. For example, a rigid panel 102-1, 102-2 may include a glass fiber board to reinforce the rigid panel relative to a sheet of fabric used for the backing layer of the rigid panel (as will be described in more detail herein). In some embodiments, a mylar or rubber sheet instead of glass fiber board provides a different aesthetic and/or reduces cost.

In at least one embodiment, a rigid panel includes a rigid board between a backing layer and a cover layer with a prayer seam enclosing the rigid board therein. In at least another embodiments, a rigid panel includes a rigid board between a backing layer and a cover layer with a butterfly seam enclosing the rigid board therein. In at least another embodiments, a rigid panel includes a rigid board between a backing layer and a cover layer with a J-seam enclosing the rigid board therein.

The first rigid panel and the second rigid panel (and, optionally, other rigid panels therebetween) are connected by a hinged connector. For example, a hinged connector includes any type of hinge, such as an elastically flexible living hinge. In some examples, the hinged connector includes an axle, pin, or mechanical interlock around which the rigid panels rotate relative to one another.

In some embodiments, an elastically flexible hinged connector includes a piece of backing material from the backing layer that is continuous between at least two of the rigid panels. In at least one embodiment, the backing layer is continuous from the first rigid panel to the second rigid panel. In some embodiments, the elastically flexible hinged connector includes a prayer seam for at least a portion of the hinged connector. In at least one embodiment, the backing layer is continuous from the first connection interface (coupled to the first rigid panel) to the second connection interface (coupled to the second rigid panel). In some embodiments, a backing layer and a cover layer are continuous from the first connection interface (coupled to the first rigid panel) to the second connection interface (coupled to the second rigid panel). In some embodiments, the backing layer includes fabric, vinyl or other polymers, leather, suede, microfiber, and other flexible materials. In some embodiments, the cover layer includes fabric, vinyl or other polymers, leather, suede, microfiber, and other flexible materials. In some embodiments, the backing layer and the cover layer are the same material. In some embodiments, the backing layer and the cover layer are different materials.

In some embodiments, the cover layer is the cosmetic surface. In some embodiments, the cosmetic surface is applied to the surface of the cover layer, such as paint, decals, writing, or other graphics. In some embodiments, a surface of a rigid board of a rigid panel is the cosmetic surface. In some embodiments, the cosmetic surface is applied to the surface of a rigid board of a rigid panel, such as paint, decals, writing, or other graphics applied to the rigid board.

In some embodiments, the backing layer is the contact surface opposite the cosmetic surface. In some embodiments, the backing layer has a frictious material applied to the backing layer. In some embodiments, a frictious material is applied to a surface of a rigid board of a rigid panel.

In some embodiments, the frictious material is positioned on each of the rigid panels. In some embodiments, the frictious material is positioned on at least one rigid panel. In some embodiments, the frictious material is positioned on the backing layer proximate at least one of the first connection interface and the second connection interface.

In some embodiments, the frictious material is a silicone. In some embodiments, the silicone is screen-printed on the backing layer. In some embodiments, the silicone is piped on the backing layer. In some embodiments, the frictious material includes polyurethane, liquid rubber, or other polymers. In some embodiments, the frictious material covers substantially all of the contact surface of the rigid panel. In some embodiments, the frictious material covers at least 50% of the contact surface of the rigid panel. In some embodiments, the frictious material covers at least 25% of the contact surface of the rigid panel. In some embodiments, the frictious material covers at least 10% of the contact surface of the rigid panel.

In some embodiments, the frictious material 116 (such as silicone) is an outer layer applied to the backing layer 106 with one or more layers of material between the frictious material 116 and the backing layer 106. In some embodiments, the frictious material 116 is an outermost layer of a plurality of layers of frictious material. In some embodiments, the frictious material 116 is screen-printed onto the backing layer 106 in a plurality of layers to achieve a desired height of the frictious material 116. In some embodiments, filler layers between the backing layer 106 and the frictious material 116 include at least a second filler material that is different from the frictious material 116. The filler material may be cheaper than the frictious material 116, easier to apply to the backing layer 106 than the frictious material 116, provide additional structural rigidity to the frictious material 116. In at least one embodiments, the filler layer(s) increases a connection or adhesion strength between the frictious material 116 and the backing layer 106 relative to the frictious material 116 applied directly to the backing layer 106 without the filler layer(s).

In some embodiments, the frictious material increases the coefficient of friction of the contact surface relative to the backing layer and/or the rigid boards of the rigid panels. In some embodiments, the frictious material is non-adhesive. For example, the frictious material increases the coefficient of friction of the contact surface relative to the backing layer and/or the rigid boards of the rigid panels without increasing an adhesion of the contact surface to the electronic device surface. For example, the frictious material increases the friction between the wrap and a surface of the electronic device in a direction parallel to the surface of the electronic device without increasing an adhesion force in a direction normal to the surface of the electronic device. In some embodiments, the frictious material is non-marking and/or non-marring of the surface of the electronic device.

In some embodiments, the selective connector includes a hook-and-loop connector, magnetic connector, snap connector, a clasp, a zipper (clasp locker), or other connection mechanism. In at least one example, a hook-and-loop selective connector (e.g., first connection interface and second connection interface) includes a hook panel and a loop panel, where at least one of the hook panel and the loop panel is or includes a rigid panel. For example, the embodiment of the second connection interface may be a loop panel that is a rigid panel. In some embodiments, a selective connector includes an elastic portion that provides a tension force on the wrap when the selective connector is connected and the wrap is positioned around at least a portion of the electronic device.

In some embodiments, a wrap is positioned with the third rigid panel (located between the first rigid panel and the second rigid panel) on a front face of an electronic gaming console. In some embodiments, the wrap includes one or more alignment features that interlock with one or more non-planar features of the electronic gaming console or other electronic device. For example, the prayer seam or other seam of an opening or aperture in the rigid panel protrudes in a direction normal to the contact surface, interlocking with and/or aligning the wrap relative to a non-planar feature of the electronic gaming console or other electronic device, such as an optical drive, a communications port, a power button, or other recesses or protrusions in the plane of the housing of the electronic gaming console or other electronic device. In some embodiments, the first rigid panel and second rigid panel each move around the hinged connector relative to the third rigid panel therebetween.

In some embodiments, the rigid board is or includes glass fiber board (similar to that in a printed circuit board), a metal sheet, polyurethane or other rigid polymer, and other substantially rigid boards or sheets of material. In at least some embodiments, the rigid board is coupled to a backing layer. In at least some embodiments, the rigid board is coupled between a backing layer and a cover layer. In at least one embodiment, a rigid panel includes a rigid board between a backing layer and a cover layer with a seam enclosing the rigid board therein. In some embodiments, the rigid panel includes a rigid board adhered to a backing layer and a cover layer with an adhesive and a seam enclosing the rigid board therein.

In some embodiments, the rigid board is or has applied thereto a cosmetic surface, such as paint, decals, or other graphics. In some embodiments, the bare rigid board is the cosmetic surface. In some embodiments, the rigid panel includes one or more detachable rigid boards that are detachable from the backing layer. For example, the rigid board may be connected to the backing layer by a reusable adhesive, by a hook-and-loop connector, magnetic connector, snap connector, a clasp, mechanical fasteners, or another connection mechanism.

In some embodiments, a wrap, according to the present disclosure, provides additional benefits to the user and/or the electronic device. In some embodiments, the frictious material and/or contact surface of the wrap provides an air gap on at least a portion of the contact surface. In some embodiments, the frictious material is located on a portion of the contact surface of one or more rigid panels. In some examples, the frictious material provides air gaps between and adjacent to the strip(s) of frictious material on the first rigid panel and the second rigid panel. In some embodiments, the air gap allows air flow and/or thermal insulation between the surface of the electronic device and the rigid panel(s). In at least one embodiment, one or more rigid panels lacks a frictious material applied to the backing layer.

In some embodiments, the frictious material applied to the contact surface follows, mimics, or matches at least a portion of a graphic on the cosmetic surface of the wrap. In some embodiments, alignment of the frictious material with at least a portion of the graphic of the cosmetic surface can provide a tactile relief to at least a portion of the cosmetic surface. In some embodiments, alignment of the frictious material can create air gaps and associated temperature variations that correspond to the graphic during use of the electronic device. In some embodiments with a transparent or translucent rigid panel, alignment of the frictious material with at least a portion of the graphic of the cosmetic surface can allow light to pass through regions of the rigid panel where the frictious material is absent providing additional cosmetic options.

As described herein, the use of segments of frictious material on the contact surface can allow air flow between the wrap and the electronic device, limiting the surface temperature of the wrap and allowing a user to more comfortably handle the device with wrap applied. In some embodiments, the rigid panel includes a thermally conductive rigid board therein, allowing the rigid panel to spread any received heat and further dissipate heat generated by the electronic device during use. In some embodiments, the rigid board is a thermally conductive metal board, such as aluminum or copper (or alloys thereof).

In some embodiments, the wrap includes one or more spacers located at a lateral edge of a rigid panel that protrude in a lateral direction perpendicular to a longitudinal direction of the wrap. In some embodiments, the spacer limits and/or prevents the wrap inhibiting airflow to the electronic device. In some embodiments, the electronic device includes at least one intake or exhaust port proximate the lateral edge of the wrap, and the spacer(s) limit and/or prevent blockage of the intake or exhaust port by the wrap.

In some embodiments, the spacers include a portion of the rigid board of the rigid panel. In some embodiments, the spacer includes a reinforced portion of a seam of the rigid panel, such as a prayer seam, a J-seam, or a butterfly seam. For example, the spacer may be reinforced with additional adhesive between a cover layer and a backing layer to stiffen the seam at the spacer to be more rigid than other portions of the seam. In some embodiments, the spacer is integral with the seam of the rigid panel. In some embodiments, the spacer is a discrete component affixed to the rigid panel. In some embodiments, the spacer is positioned proximate to the longitudinal center of the lateral edge.

In some embodiments, the spacer proximate a hinged connector allows the spacer to contact the ground, a tabletop, or another surface first to provide impact protection to the electronic device within the wrap. As the wrap includes rigid panels, the rigid panels receive the impact at the corner with the spacer and distribute the energy through the rigid panel(s) over a larger area. In some embodiments, the wrap includes bumpers or other reinforcements of the wrap to further absorb, distribute, or dissipate impact energy.

In some embodiments, a wrap includes a spacer on a rear side of the wrap (when assembled on an electronic device) and/or proximate the selective connector including a first connection interface and second connection interface. In some embodiments, the spacer proximate the rear side and/or proximate the selective connector limits and/or prevents movement of the wrap relative to the electronic device (e.g., slipping downward) without being visible to the user during use. The spacer proximate the rear side and/or proximate the selective connector provides an additional cosmetic option while achieving the function of the spacer.

In some embodiments, the rigid panel(s) allow the wrap to support the mass of additional devices, such as accessory device(s) and peripheral devices for the wrapped electronic device. In some embodiments, the wrap includes an accessory support such as a headphones hook.

In some embodiments, the rigid panel includes an accessory connection point that allows customization of the wrap and/or an accessory support. In some embodiments, at least one of the accessory supports and/or accessory connection points is longitudinally or laterally aligned with a spacer. For example, when an accessory device is supported by the accessory support and/or accessory connection point, the rigid panel transfers the force of the weight of the accessory device to the ground, tabletop, or other surface on which the wrapped electronic device rests through the spacer contacting the ground, tabletop, or other surface.

The present disclosure relates to systems and methods for wrapping an electronic device according to at least the examples provided in the clauses below:

Clause 1. A device comprising: a first rigid panel having a contact surface and a cosmetic surface; a second rigid panel having a contact surface and a cosmetic surface, the second rigid panel movably connected to the first rigid panel by a hinged connector; a frictious material positioned on at least one contact surface; and a selective connector, including: a first connection interface coupled to the first rigid panel, and a second connection interface coupled to the second rigid panel.

Clause 2. The device of clause 1, wherein the hinged connector is an elastically flexible connector.

Clause 3. The device of clause 1, wherein the selective connector includes a hook-and-loop connection.

Clause 4. The device of clause 3, wherein the first connection interface and the second connection interface includes a hook panel and a loop panel, and at least one of the hook panel and loop panel is rigid.

Clause 5. The device of clause 1, wherein the frictious material is on the contact surface of the first rigid panel, and the second rigid panel further includes frictious material on the contact surface of the second rigid panel.

Clause 6. The device of clause 1, wherein the cosmetic surface of the first rigid panel and the cosmetic surface of the second rigid panel are continuous with one another.

Clause 7. The device of clause 1, wherein the frictious material is non-adhesive.

Clause 8. The device of clause 1, wherein the frictious material includes silicone.

Clause 9. The device of clause 1, wherein the cosmetic surface includes a fabric.

Clause 10. The device of clause 9, wherein the fabric is continuous between the first rigid panel, the hinged connector, and the second rigid panel.

Clause 11. The device of clause 1, further comprising an accessory connection point.

Clause 12. The device of clause 1, wherein at least one of the first rigid panel and the second rigid panel includes a rigid board coupled to a backing layer.

Clause 13. A device comprising: a first rigid panel having a contact surface and a cosmetic surface; a second rigid panel having a contact surface and a cosmetic surface, the second rigid panel movably connected to the first rigid panel by a hinged connector longitudinally between the first rigid panel and the second rigid panel; a frictious material positioned on at least one contact surface; at least one spacer protruding from at least one of the first rigid panel and the second rigid panel in a lateral direction perpendicular to a longitudinal direction, and a selective connector including: a first connection interface coupled to the first rigid panel, and a second connection interface coupled to the second rigid panel.

Clause 14. The device of clause 13, wherein the spacer is proximate to the hinged connector.

Clause 15. The device of clause 13, wherein the spacer is proximate to the selective connector.

Clause 16. The device of clause 13, wherein the spacer is proximate to a longitudinal center of the at least one of the first rigid panel and the second rigid panel in the longitudinal direction.

Clause 17. The device of clause 13, wherein the spacer includes a portion of a rigid board.

Clause 18. The device of clause 13, wherein the spacer is reinforced relative to an adjacent seam.

Clause 19. A system comprising: an electronic device wherein a first side of the electronic device includes a non-planar feature normal to the first side; and a wrap including: a first rigid panel having a contact surface and a cosmetic surface, a second rigid panel having a contact surface and a cosmetic surface, the second rigid panel movably connected to the first rigid panel by a hinged connector, a frictious material on at least one contact surface of the wrap, at least one alignment feature protruding from a contact surface of at least one rigid panel, and a selective connector including: a first connection interface coupled to the first rigid panel, and a second connection interface coupled to the second rigid panel.

Clause 20. The system of clause 19, the cover further including at least one spacer protruding from at least one of the first rigid panel and the second rigid panel in a lateral direction perpendicular to a longitudinal direction.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about", "substantially", or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

It should be understood that any directions or reference frames in the preceding description are merely relative directions or movements. For example, any references to "front" and "back" or "top" and "bottom" or "left" and "right" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A device comprising:

a first rigid panel having a contact surface and an opposing cosmetic surface that includes a cosmetic line pattern;

a second rigid panel having a contact surface and an opposing cosmetic surface, the second rigid panel movably connected to the first rigid panel by a hinged connector;

a frictious material positioned on the contact surface of the first rigid panel and having a line pattern corresponding to the cosmetic line pattern; and a selective connector, including:

a first connection interface coupled to the first rigid panel, and a second connection interface coupled to the second rigid panel.

2. The device of claim 1, wherein the hinged connector is an elastically flexible connector.

3. The device of claim 1, wherein the selective connector includes a hook-and-loop connection.

4. The device of claim 3, wherein the first connection interface and the second connection interface include a hook panel and a loop panel, and at least one of the hook panel and the loop panel is rigid.

5. The device of claim 1, wherein the second rigid panel further includes frictious material on the contact surface of the second rigid panel.

6. The device of claim 1, wherein the cosmetic surface of the first rigid panel and the cosmetic surface of the second rigid panel are continuous with one another.

7. The device of claim 1, wherein the frictious material is non-adhesive.

8. The device of claim 1, wherein the frictious material includes silicone.

9. The device of claim 1, wherein the cosmetic surface of the first rigid panel includes a fabric.

10. The device of claim 9, wherein the fabric is continuous between the first rigid panel, the hinged connector, and the second rigid panel.

11. The device of claim 1, further comprising an accessory connection point.

12. The device of claim 1, wherein at least one of the first rigid panel and the second rigid panel includes a rigid board coupled to a backing layer.

13. A device comprising:

a first rigid planar panel having a contact surface and a cosmetic surface that includes a cosmetic line pattern;

a second rigid panel having another contact surface and another cosmetic surface, the second rigid panel movably connected to the first rigid planar panel by a hinged connector longitudinally between the first rigid planar panel and the second rigid panel;

a raised frictious material positioned on less than an entirety of the contact surface of the first rigid planar panel and having a line pattern corresponding to the cosmetic line pattern;

a spacer protruding from at least one of the first rigid planar panel and the second rigid panel in a lateral direction perpendicular to a longitudinal direction, and a selective connector including:

a first connection interface coupled to the first rigid planar panel, and a second connection interface coupled to the second rigid panel.

14. The device of claim 13, wherein the spacer is proximate to the hinged connector.

15. The device of claim 13, wherein the spacer is proximate to the selective connector.

16. The device of claim 13, wherein the spacer is proximate to a longitudinal center of the first rigid planar panel in the longitudinal direction.

17. The device of claim 13, wherein the spacer includes a portion of a rigid board.

18. The device of claim 13, wherein the spacer is reinforced relative to an adjacent prayer seam.

19. A system comprising:

an electronic device having a first side that includes a non-planar feature normal to the first side; and a wrap including:

a first rigid panel having a contact surface and a cosmetic surface that includes a cosmetic line pattern, the first rigid panel comprising an alignment feature protruding from the contact surface to interact with the non-planar feature of the first side of the electronic device, a second rigid panel having a contact surface and a cosmetic surface, the second rigid panel movably connected to the first rigid panel by a hinged connector, a raised frictious material positioned on less than an entirety of the contact surface of the first rigid panel having a line pattern corresponding to the cosmetic line pattern and configured to allow airflow between a remainder of the first rigid panel and the electronic device, and a selective connector including:

a first connection interface coupled to the first rigid panel, and a second connection interface coupled to the second rigid panel.

20. The system of claim 19, the wrap further including at least one spacer protruding from at least one of the first rigid panel and the second rigid panel in a lateral direction perpendicular to a longitudinal direction.

* * * * *